US007390402B1

(12) United States Patent
Rhoades, Sr.

(10) Patent No.: US 7,390,402 B1
(45) Date of Patent: Jun. 24, 2008

(54) SKIMMER-DIVERTER ASSEMBLY FOR ASSISTING IN THE REMOVAL OF DEBRIS FROM SWIMMING POOLS

(76) Inventor: Gregory E. Rhoades, Sr., 1932 N. Green River Rd., Evansville, Vanderburgh County, IN (US) 47715

( * ) Notice: Subject to any disclaimer, the term of this patent is extended or adjusted under 35 U.S.C. 154(b) by 0 days.

(21) Appl. No.: 11/542,503

(22) Filed: Oct. 3, 2006

(51) Int. Cl.
*E04H 4/14* (2006.01)
*E04H 4/12* (2006.01)

(52) U.S. Cl. ..... 210/167.18; 210/232; 210/238; 210/416.2; 4/496

(58) Field of Classification Search ..... 210/167.1, 210/167.18, 232, 238, 416.1, 416.2; 4/496, 4/507

See application file for complete search history.

(56) References Cited

U.S. PATENT DOCUMENTS 3,724,666 A * 4/1973 Johnson ..... 210/167.1
4,734,189 A * 3/1988 Page, Jr. ..... 210/167.18
5,510,020 A * 4/1996 Gronlund ..... 210/167.18

FOREIGN PATENT DOCUMENTS

CA 2083703 A1 * 3/1994

* cited by examiner

*Primary Examiner*—Fred G. Prince
(74) *Attorney, Agent, or Firm*—Gary K. Price, Esq.

(57) ABSTRACT

A skimmer-diverter assembly that cooperates with a conventional water circulating and filtration system of a swimming pool, the skimmer-diverter assembly comprising a diverter releasably attached to a mounting bracket that is removably attached to a skimmer inlet opening of the swimming pool filtration system. The diverter including upper and lower diverter housings each diverter housing having an upwardly extending pin. The mounting bracket including upper and lower bracket housings each of the housings having a bore sized to receive the pin of the diverter housings. The diverter further including a handle.

14 Claims, 4 Drawing Sheets

SKIMMER-DIVERTER ASSEMBLY FOR ASSISTING IN THE REMOVAL OF DEBRIS FROM SWIMMING POOLS

CROSS REFERENCES TO RELATED APPLICATIONS

None.

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates generally to a debris removal apparatus for swimming pools and more particularly to a swimming pool deflector for directing floating debris into a swimming pool's standard pool skimming system.

2. Brief Description of Prior Art

Modern swimming pools are almost universally equipped with filtration systems which, when operative, continually remove water from the swimming pool through inlet openings provided in the sides of the swimming pool. As the water is moved through these inlet openings, debris on the surface of the water in the swimming pool is also removed through the inlet openings and is subsequently filtered from the water which is then returned into the swimming pool. This filtration system creates a current which flows around the inner periphery of the pool and causes the water and surface debris to flow outwardly to be removed through the inlet openings. These devices are commonly referred to as skimmers.

While skimmers will eventually remove surface debris from the entire surface of the swimming pool, only the water and surface debris immediately adjacent the periphery of the swimming pool is removed by the skimmer because the inlet openings are parallel to the current flow of water past the opening. Therefore, it often takes several hours for surface debris to move outwardly against the periphery of the swimming pool so that it can be removed by conventional skimmers.

It has been previously proposed that the efficiency of conventional skimmers may be increased by deflector devices which extend outwardly from the side of a pool at one or more of the inlet openings of the skimmer for deflecting surface debris and water into the inlet openings as the current causes such surface debris and water to flow past the inlet openings. Disadvantages of such previously proposed deflector devices have related to the difficulty in installing the deflectors to the side wall of the pool. Other deflector devices are semi-permanently installed causing potential hazards when the pool is in use if the deflector devices remain projecting outwardly into the swimming pool.

Therefore, it can be appreciated that there exists a continuing need for a new and improved deflector assembly for assisting a swimming pool skimmer in removing debris from the surface of water in the swimming pool. As will be seen from the subsequent description, the preferred embodiments of the present invention overcome limitations and shortcomings of the prior art.

SUMMARY OF THE INVENTION

The present invention in the preferred embodiment is a skimmer-diverter assembly for assisting the removal of debris from swimming pools. More particularly, the system of the present invention cooperates with the water circulating and filtration system of a swimming pool to divert debris into the pool skimmer inlet opening with enhanced efficiency. The diverter assembly generally comprising a diverter releasably attached to a mounting bracket that is attached adjacent the conventional skimmer inlet opening of the swimming pool's filtration system.

DESCRIPTION OF THE PREFERRED EMBODIMENT

Figure 1:
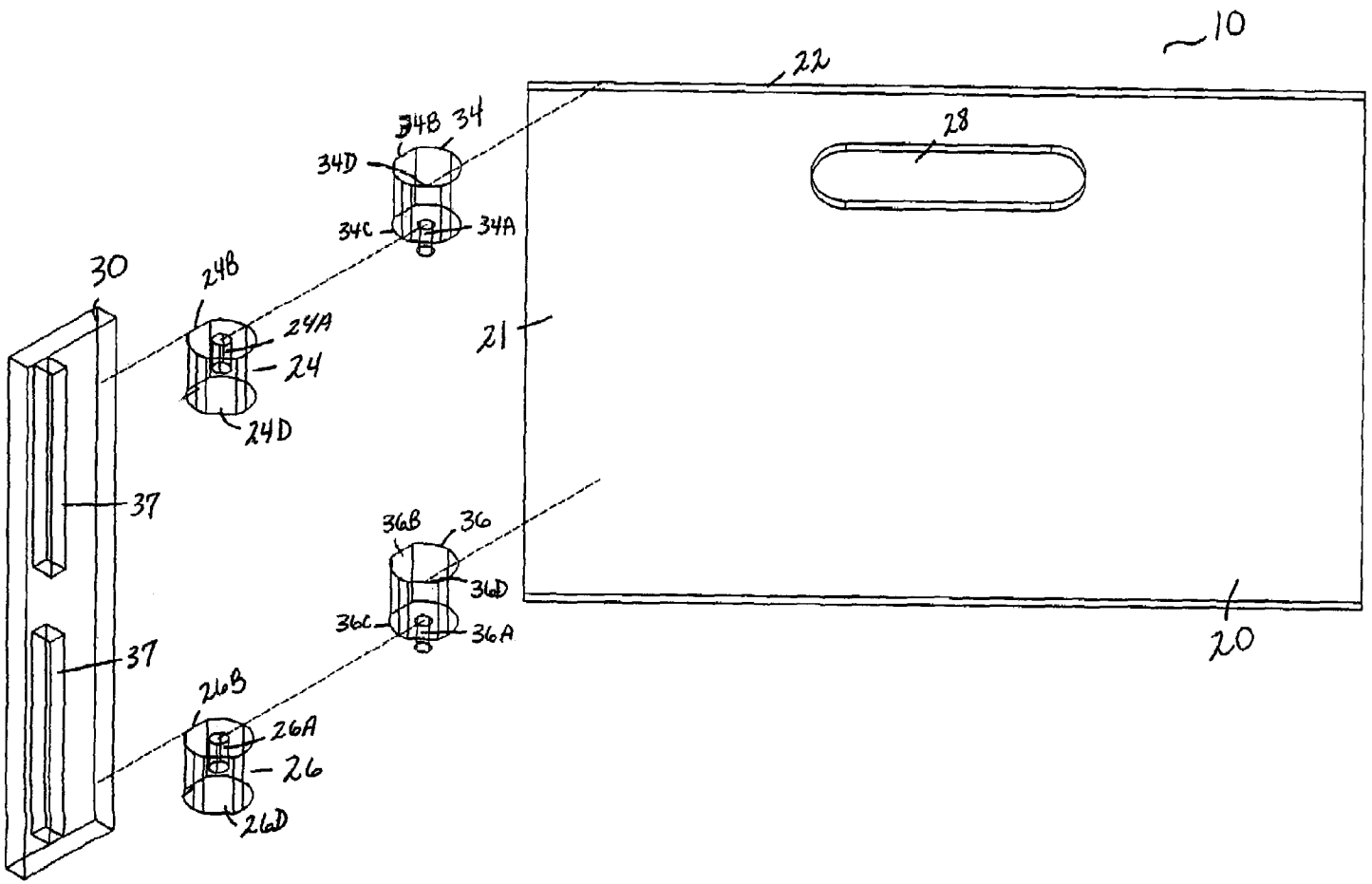
FIG. 1 is an exploded view of the present invention, a skimmer-diverter assembly.
Figure 2:
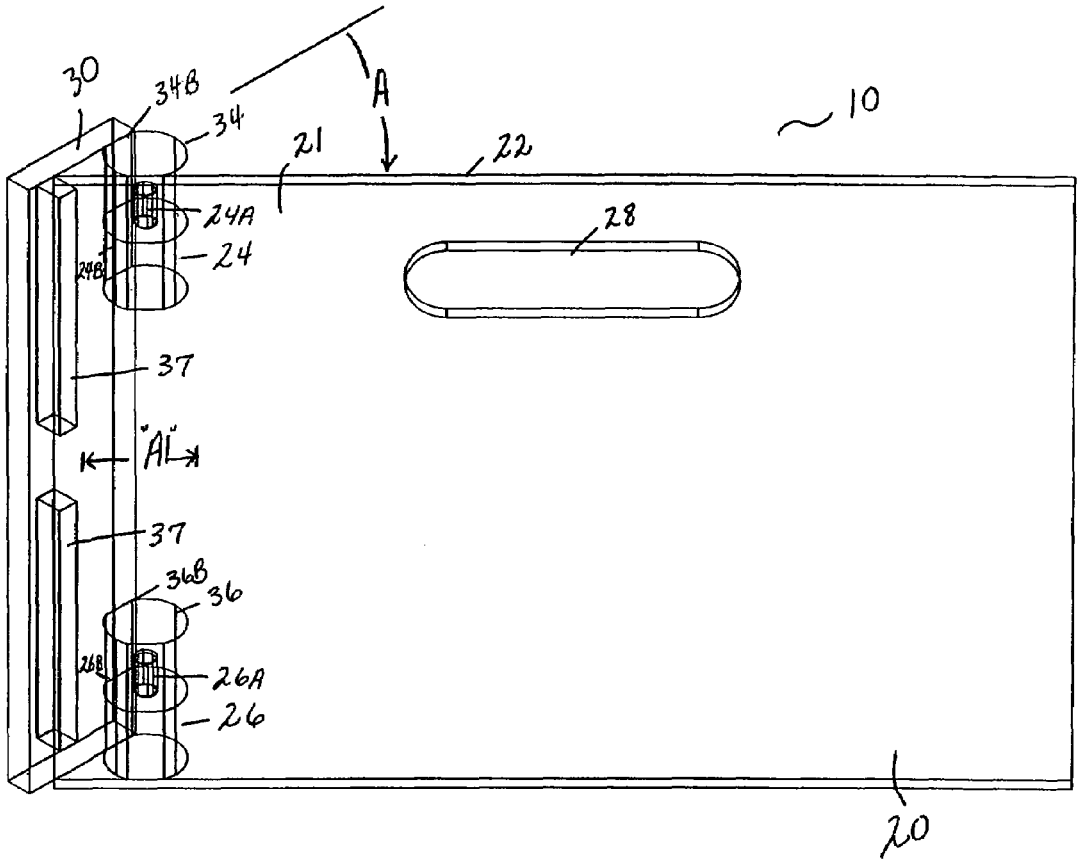
FIG. 2 is an isometric view of the skimmer-diverter assembly of FIG. 1.
Figure 3:
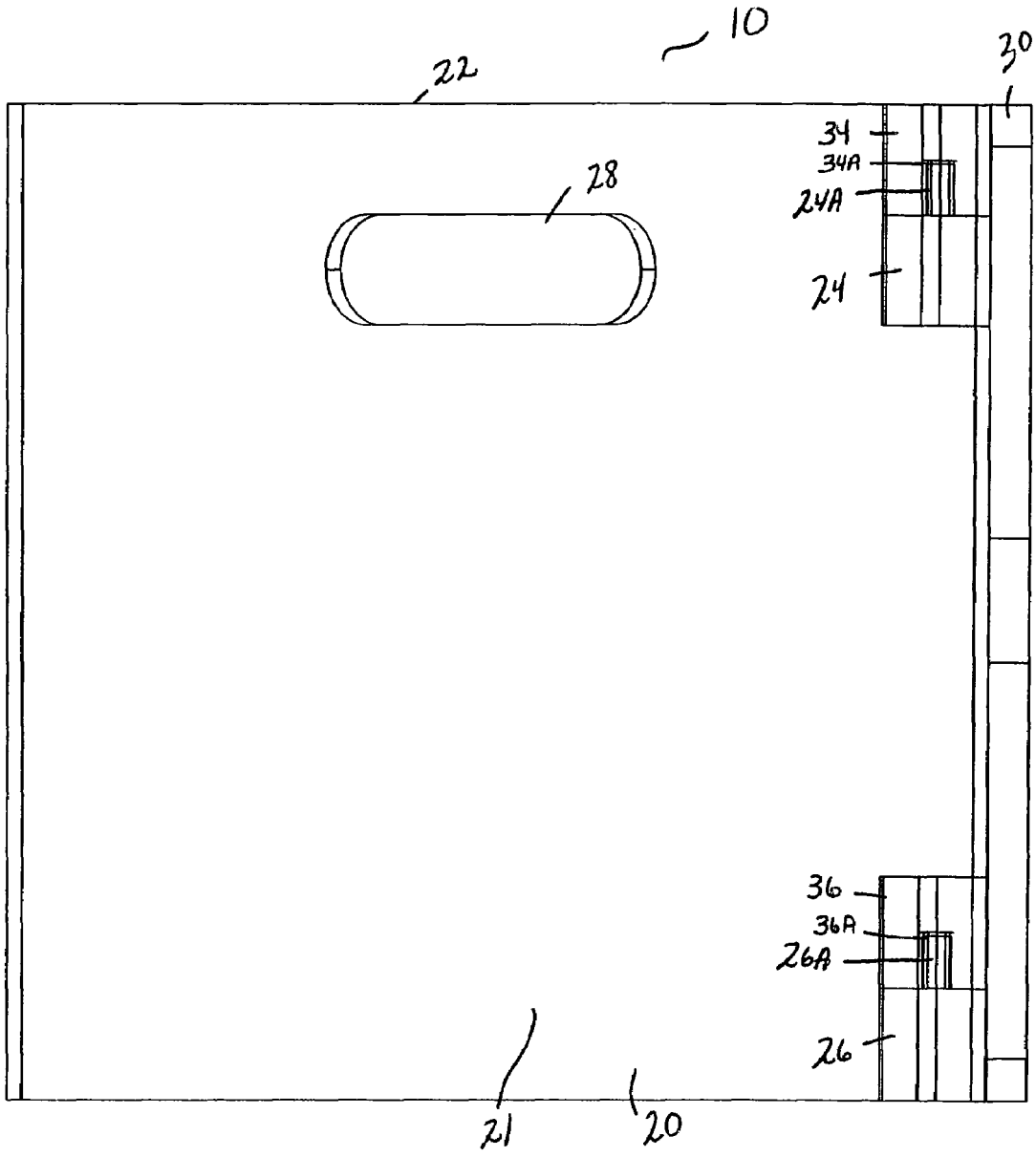
FIG. 3 is a plan view of the skimmer-diverter assembly of FIG. 1.
Figure 4:
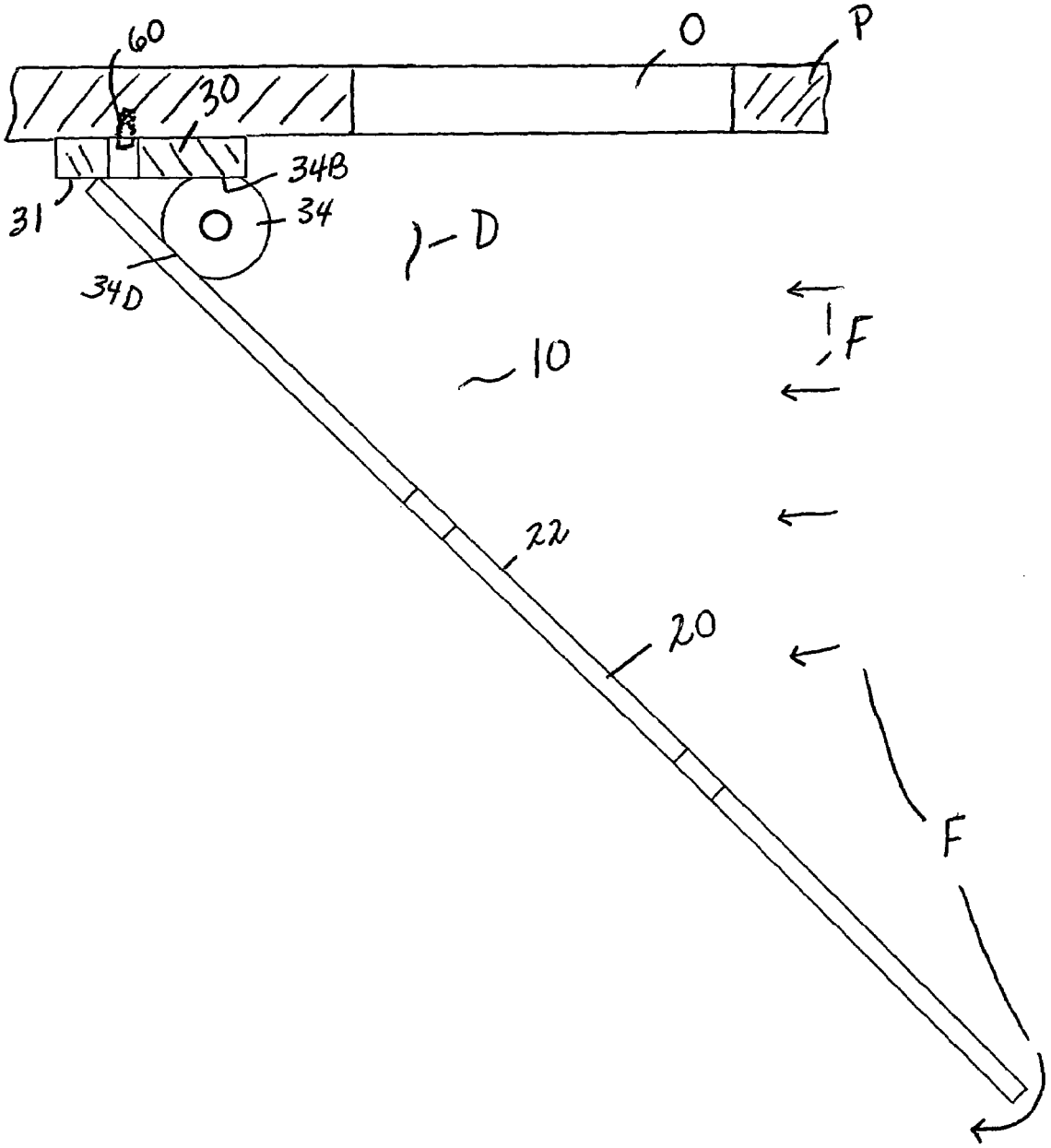
FIG. 4 is a top view of the skimmer-diverter of FIG. 1.

The conventional filtration system of a swimming pool employs circulating pumps which maintain a flow of water, indicated by arrows "F" in FIG. 4, from the pool through the filters and return the filtered water back to the pool. The first stage of the filter system includes a skimmer inlet opening generally disposed on the side of the pool such that floating debris "D" in FIG. 4, passing near the skimmer inlet opening is sucked into that intake and collected in a trap. The trap is then periodically cleaned in a conventional manner. The skimmer inlet opening is standard in most pools, with only minor variations in size and distance from the edge of the pool.

The skimmer-diverter of the present invention enhances the efficiency of the pool skimmer inlet opening by effectively diverting floating debris "D" as the debris works its way towards the outer periphery (but not yet immediately adjacent the inlet opening) of the swimming pool "P" in FIG. 4, and makes contact with the diverter. Such debris "D", once it is in contact with the diverter, is then sucked into the skimmer inlet opening "O" in FIG. 4, and collected in the trap of the filtration system.

FIGS. 1-4 illustrate the preferred embodiment of a skimmer-diverter assembly 10 made in accordance with the present invention. The skimmer-diverter assembly 10 designed for directing floating debris into a swimming pool's standard pool skimming system. The diverter system 10 cooperates with the water circulating and filtration system of the swimming pool to divert debris "D" into the pool skimmer's inlet opening "O" with enhanced efficiency.

The diverter assembly 10 generally comprising a diverter 20 in the general shape of a flat rectangle and a mounting bracket 30 releasably attached to the diverter 20 with attachment means 40 unique to the present invention. As will be further described, the mounting bracket 30 is further removably attached adjacent to the skimmer inlet opening of the swimming pool filtration system with threaded bolts (not shown).

As shown in the drawings, the diverter 20 is substantially rectangular in shape and in application, is preferably disposed at a 45 degree angle (designated "A" in FIG. 2) in relation to the mounting bracket 30 and the inlet opening of the pool. In application, the diverter 20 of the assembly 10 diverts debris floating in the swimming pool of water towards the inlet opening of the swimming pool's filtration system. As the debris works its way in contact with the diverter 20, the debris "D", once in contact with the diverter 20 is then sucked into the inlet opening "O" and collected in the trap (not shown) of the filtration system.

The diverter 20 further includes upper and lower diverter housings 24, 26 respectively, disposed on a surface 21 of the diverter 20. The diverter housings 24, 26 each include an upwardly extending pin 24A, 26A, and flat sides 24B and D, 26B and D, respectively. As will be further described, the diverter housings 24, 26 are designed for releasably engaging similar housings 34, 36 attached to the mounting bracket 30.

The diverter 20 preferably includes an opening 28 disposed at an upper end 22 of the diverter 20. The opening 28 can serve as a handle when attaching or detaching the diverter 20 to the mounting bracket 30 as will be further discussed.

The mounting bracket 30 preferably has a rectangular configuration and is attached adjacent the swimming pool's inlet opening "O". In particular, the mounting bracket 30 includes at least one elongated opening 37 disposed along the length of the mounting bracket 30. The mounting bracket 30 is attached by inserting at least a pair of threaded bolts 60, in FIG. 4, through the elongated opening 37 and into threaded engagement with the side of the pool "P". Further, FIG. 4 shows a portion of the pool "P" wall in cross-section to show the inlet opening "O" of the pool skimmer. Arrows "F" show flow of water into and past the diverter 20 but debris "D" tends to get trapped and forced by the angle "A" of the diverter 20 into the opening "O".

The mounting bracket 30 further includes upper and lower bracket housings 34, 36 respectively, disposed on a surface 31 of the mounting bracket 30. The bracket housings 34, 36 each include a bore 34A, 36A (shown in hidden lines) disposed on ends 34C, 36C of the housings 34, 36 and a flat side 34B and 34D, 36B and 36D. The bores 34A, 36A of the bracket housings 34, 36 are sized to receive the pins 24A, 26A of the diverter housing 24, 26, respectively. As should be further understood, the size and shape of the diverter housings 24, 26 is substantially identical to the size and shape of the bracket housings 34, 36.

In application, the mounting bracket 30 is attached to the pool "P" as discussed above. The diverter 20 can be attached to the mounting bracket 30 by aligning the diverter 20 with the attached mounting bracket 30 so that the bores 34A, 36A are aligned and directly above the pins 24A, 26A, and so that the flat sides 24B, 26B of the diverter 20 are in communication with the surface 31 of the mounting bracket 30 and the flat sides 34B, 36B of the mounting bracket 30 are in communication with the surface 21 of the diverter 20. In this position, the diverter 20 is urged upward so that the pins 24A, 26A are received within the bores 34A, 36A of the mounting bracket 30, thereby attaching the diverter 20 to the mounting bracket 30. As should be understood, the diverter 20 can be manipulated and positioned by the user in relation to the mounting bracket 30 as discussed above using the diverter's 20 handle 28.

The diverter 20 can detach from the mounting bracket 30 by urging the diverter 20 upward until the pins 24A, 26A release from the bores 34A, 36A. As can be seen in FIG. 4, the end of diverter 20 bearing against surface 31 holds the diverter at the 45 degree angle "A" and prevents it from pivoting with the water flow.

In use, the diverter 20 enhances the efficiency of the pool skimmer inlet opening by diverting floating debris as the debris works its way in contact with the diverter 20. Such debris, once it is in contact with the diverter 20, is then sucked in through the opening of the skimmer inlet opening and collected in the trap of the filtration system. The debris is further sucked from the inlet opening and collected in the trap of the filtration system.

Although the description above contains many specificities, these should not be construed as limiting the scope of the invention but as merely providing illustrations of some of the presently preferred embodiments of this invention.

Thus the scope of the invention should be determined by the appended claims in the formal application and their legal equivalents, rather than by the examples given.

I claim:

1. A skimmer-diverter assembly that cooperates with a conventional water circulating and filtration system of a swimming pool, the skimmer-diverter assembly comprising:

a diverter, a mounting bracket, attaching means to releasably attach said diverter to said mounting bracket, and wherein said mounting bracket is removably attached to a skimmer inlet opening of a swimming pool filtration, wherein said attaching means includes upper and lower diverter housings attached to said diverter, said diverter housings each including a pin, and said attaching means further includes upper and lower bracket housings attached to said mounting bracket, said upper and lower bracket housings each including a bore sized to receive said pin of each of said diverter housings, said diverter further including a handle.

2. The skimmer-diverter assembly as recited in claim 1, wherein the diverter having a substantially rectangular shape.

3. The skimmer-diverter assembly as recited in claim 1, wherein the diverter is disposed at a 45 degree angle in relation to the mounting bracket.

4. The skimmer-diverter assembly as recited in claim 1, wherein the mounting bracket having a substantially rectangular shape.

5. The skimmer-diverter assembly as recited in claim 4, wherein said mounting bracket further includes an elongated opening disposed along the length of said mounting bracket.

6. A skimmer-diverter assembly for use with a swimming pool comprising:

a diverter, a mounting bracket mounted to a wall of a swimming pool, upper and lower diverter housings attached to said diverter, said diverter housing each including a pin, and upper and lower bracket housings attached to said mounting bracket, said upper and lower bracket housings each including a bore sized to receive said pin of said diverter housings, and a handle such that said diverter can be lifted separating said pins from said bores to remove said diverter.

7. The skimmer-diverter assembly as recited in claim 6, wherein said upper and lower diverter housings include a first flat surface contacting said mounting bracket and a second flat surface contacting a diverter surface to hold said diverter at a 45 degree angle with a surface of said mounting bracket.

8. The skimmer-diverter assembly as recited in claim 7, wherein said mounting bracket is a thin, rectangular plate mounted flat to the pool wall.

9. The skimmer-diverter assembly as recited in claim 6, wherein said upper and lower bracket housings include a first flat surface contacting said mounting bracket and a second flat surface contacting a diverter surface to hold said diverter at a 45 degree angle with a surface of said mounting bracket.

10. The skimmer-diverter assembly as recited in claim 9, wherein a portion of said diverter contacts said mounting bracket to prevent movement of said diverter.

11. A skimmer-diverter assembly that cooperates with a conventional water circulating and filtration system of a swimming pool, the skimmer-diverter assembly comprising:

a diverter, a flat mounting bracket mounted to a wall of a swimming pool, upper and lower diverter housings attached to said diverter, said diverter housings each including a pin, and upper and lower bracket housings attached to said mounting bracket, said upper and lower bracket housings each including a bore sized to receive said pin of each of said diverter housings, and said diverter can be lifted separating said pins from said bores to remove said diverter and said upper and lower diverter housings.

12. The skimmer-diverter assembly as recited in claim 11, wherein said upper and lower diverter housings are cylindrical and include a first flat surface contacting said mounting bracket and a second flat surface contacting a diverter surface to hold said diverter at an angle with a surface of said mounting bracket.

13. The skimmer-diverter assembly as recited in claim 11, wherein said upper and lower bracket housings are cylindrical and include a first flat surface contacting said mounting bracket and a second flat surface contacting a diverter surface to hold said diverter at an angle with a surface of said mounting bracket.

14. The skimmer-diverter assembly as recited in claim 12, wherein a portion of said diverter contacts said mounting bracket to prevent movement of said diverter.

* * * * *